US008058984B2

(12) United States Patent
Liu

(10) Patent No.: US 8,058,984 B2
(45) Date of Patent: Nov. 15, 2011

(54) SYSTEMS AND METHODS FOR MANAGING SITE SECURITY THROUGH A COMMUNICATION DEVICE

(75) Inventor: Kun-Fu Liu, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 492 days.

(21) Appl. No.: 12/272,791

(22) Filed: Nov. 18, 2008

(65) Prior Publication Data

US 2009/0189758 A1 Jul. 30, 2009

(30) Foreign Application Priority Data

Jan. 25, 2008 (CN) ..... 2008 1 0300222

(51) Int. Cl.
*G08B 1/08* (2006.01)

(52) U.S. Cl. ..... 340/539.1; 340/539.11; 340/540; 340/541; 340/546; 340/870.1; 340/693.1; 340/693.5; 455/404.1; 455/410; 455/466; 455/570

(58) Field of Classification Search ..... 340/539.1, 340/539.11, 540, 541, 546, 870.1, 693.1, 340/693.5; 455/404.1, 410, 466, 570
See application file for complete search history.

(56) References Cited

U.S. PATENT DOCUMENTS 4,857,912 A * 8/1989 Everett et al. ..... 340/508
6,658,091 B1 * 12/2003 Naidoo et al. ..... 379/37
7,304,572 B2 * 12/2007 Sheynman et al. ..... 340/539.14
7,373,395 B2 * 5/2008 Brailean et al. ..... 709/219

FOREIGN PATENT DOCUMENTS

CN 1719855 A 1/2006
CN 2859948 Y 1/2007

* cited by examiner

*Primary Examiner* — Tai T Nguyen

(74) *Attorney, Agent, or Firm* — Altis Law Group, Inc.

(57) ABSTRACT

A computing system for managing site security through a communication device includes a mobile communication device, a notification, and the communication device. Using BLUETOOTH technology, the mobile communication device communicates with and activates the communication device and the notification. The communication device detects any noteworthy event and captures visual data accordingly, and transmits the visual data to the mobile communication device. The notification generates visual and audio alerts. A related method and storage medium with instructions for performance of the method also provided.

17 Claims, 4 Drawing Sheets

SYSTEMS AND METHODS FOR MANAGING SITE SECURITY THROUGH A COMMUNICATION DEVICE

BACKGROUND

1. Field of the Invention

Embodiments of the present disclosure are related to systems and methods for managing site security, and in particular to a system and method for managing site security through a communication device.

2. Description of Related Art

Security technology in commercial use may include infrared (IR) detection and alarm systems. An IR sensor may detect events or activity and the alarm system may notify responsible parties thereof. However, such detection and notification measures may not take place in time for appropriate action to be taken, and no information regarding the events is recorded.

As mobile communication devices become more commonly used, opportunities for real-time delivery of information are dramatically increased, especially when combined with advances in wireless data transmission capability.

Therefore, what is needed is a system and method for site security management utilizing notification of security events via a communication device.

DETAILED DESCRIPTION OF CERTAIN INVENTIVE EMBODIMENTS

Figure 2:
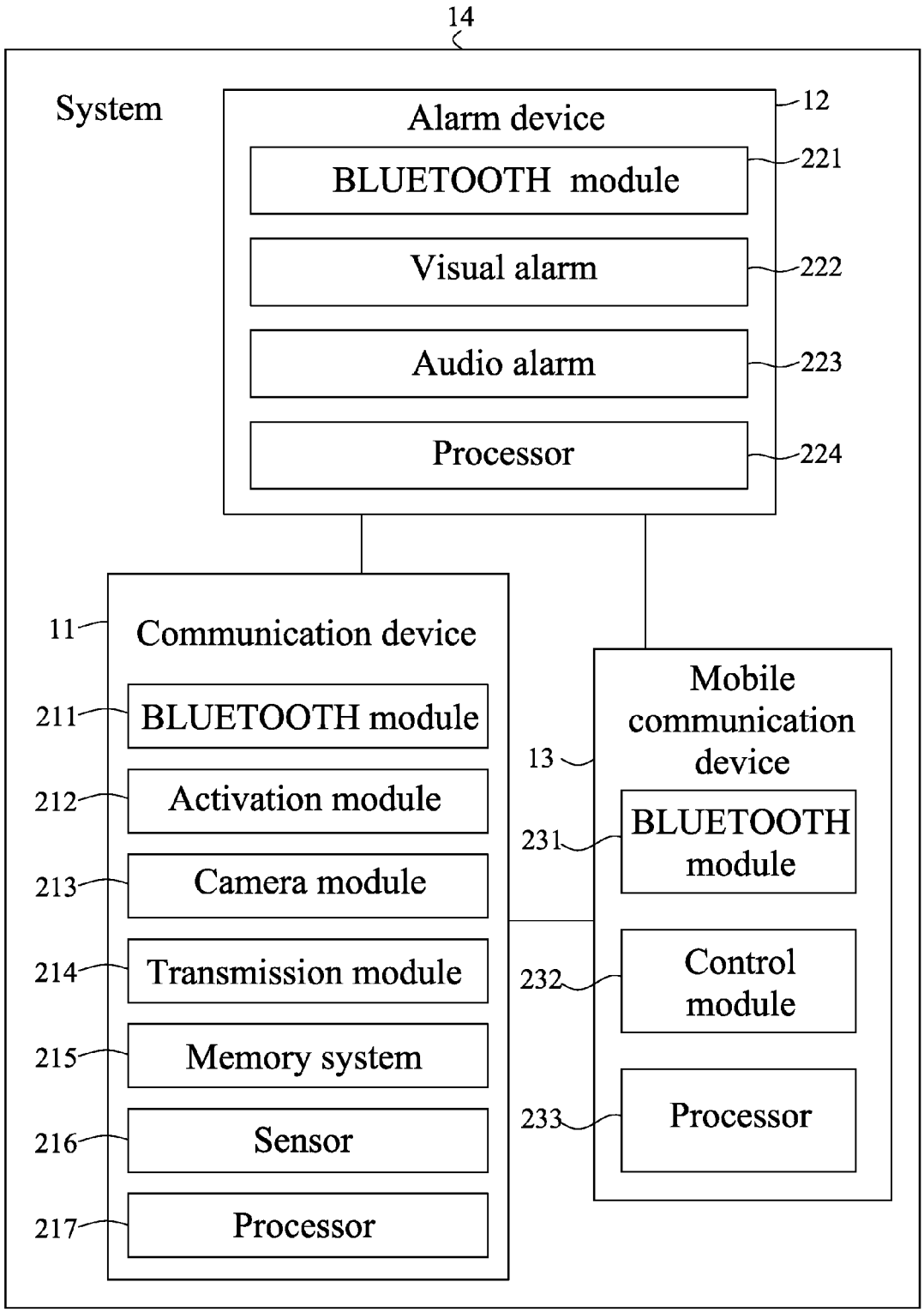
FIG. 2 is a block diagram of an embodiment of function modules of the system of FIG. 1.

All of the processes described may be embodied in, and fully automated via, software code modules executed by one or more general purpose computers or processors as depicted in FIG. 2. The code modules may be stored in any type of non-transitory computer-readable medium or other storage device. Some or all of the methods may alternatively be embodied in specialized computer hardware or communication apparatus.

Figure 1:
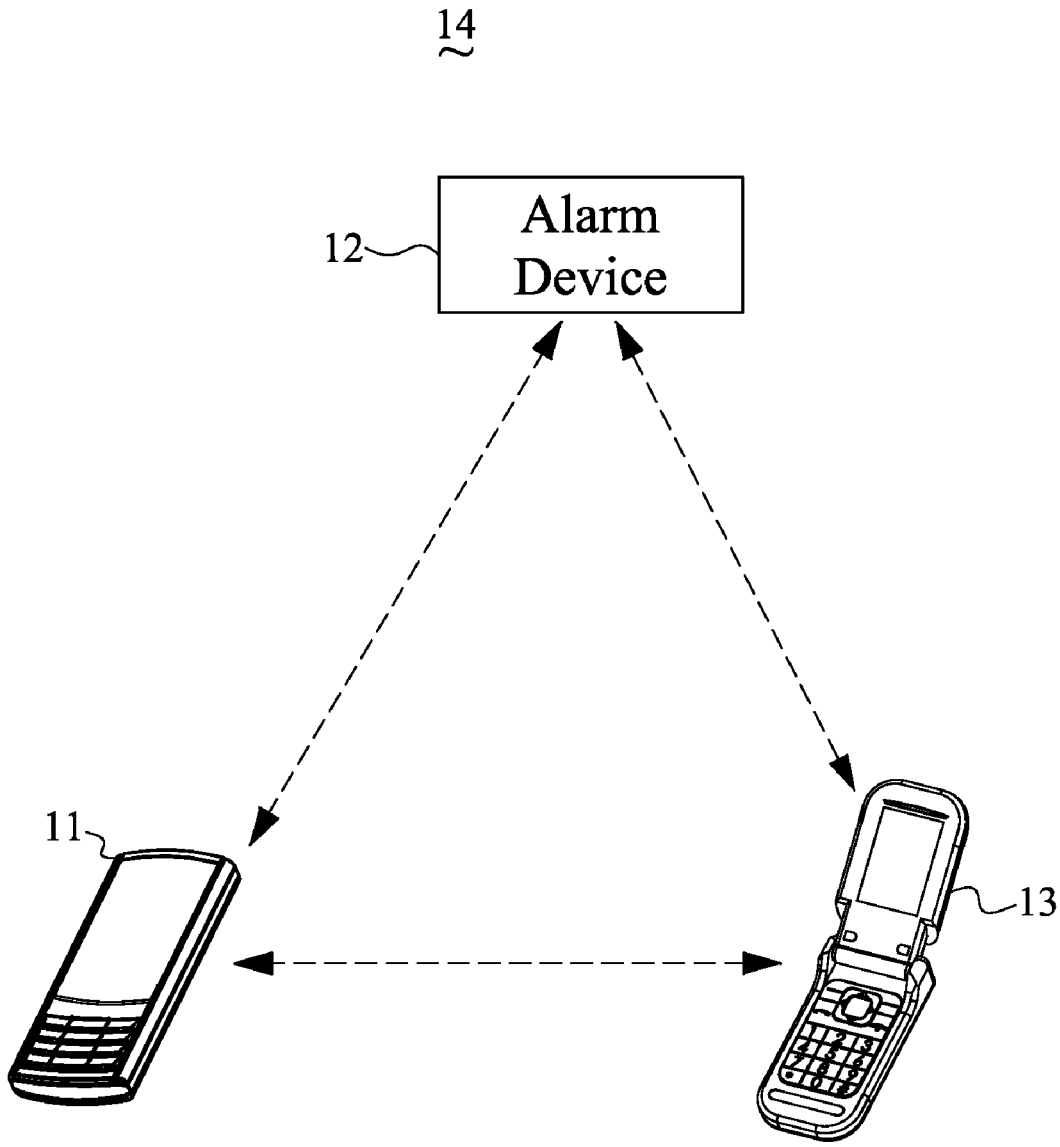
FIG. 1 is a simplified block diagram of an embodiment of a system for managing site security through a communication device.

FIG. 1 is a simplified block diagram of an embodiment of a system 14 for managing site security through a communication device 11. The system 14 includes the communication device 11, an alarm device 12, and a mobile communication device 13. The communication device 11 is installed at the site to be monitored and the mobile communication device 13 can be transported with the user. The communication device 11 may be installed at an entrance or any location appropriate with visibility of a specific area to be monitored. The communication device 11 is configured for capturing visual data such as images or video if a noteworthy event occurs. The communication device 11 is also configured for transmitting captured visual data to the mobile communication device 13 such that the user may take appropriate action immediately. The alarm device 12 generates an audio alert, a visual alert, or a combination of the audio alert and the visual alert.

In the embodiment of the present disclosure, the communication device 11 includes a BLUETOOTH module 211, the alarm device 12 includes a BLUETOOTH module 221, and the mobile communication device 3 includes a BLUETOOTH module 231. BLUETOOTH modules 211, 221, and 231 are configured for establishing wireless connections between the communication device 11, the alarm device 12, and the communication device 13. Alternatively, the communication device 11, the alarm device 12, and the communication device 13 may use other wireless communication protocols to establish the wireless connections. In addition, the communication device 11, the alarm device 12, and the mobile communication device 13 are configured to communicate with each other via BLUETOOTH connections and transfer commands and notifications remotely. In this exemplary embodiment, the user activates the communication device 11 and the alarm device 12 through a wireless connection of BLUETOOTH established between the BLUETOOTH modules of the mobile communication device 13 and of the alarm device 12 to initiate monitoring of the site. If the communication device 11 detects an abnormal sound, action, vibration or any other behavior deemed untoward, the communication device 11 activates its camera module 213 to capture the visual data. The communication device 11 and the mobile communication device 13 may use a Global System for Mobile communication system (GSM) network or other wireless communication networks to maintain additional wireless communication. Through a wireless communication network, the communication device 11 transmits the captured visual data of the noteworthy event to the mobile communication device 13 so the user may take the appropriate action immediately.

FIG. 2 is a block diagram of an embodiment of function modules of the system of FIG. 1. The system includes the communication device 11, the alarm device 12, and the mobile communication device 13. In an embodiment, the communication device 11 includes a BLUETOOTH module 211, an activation module 212, a camera module 213, a transmission module 214, a memory system 215, and a processor 216. The modules 211, 212, 213, 214, and 215 may be used to execute one or more operations for the communication device 11. Additionally, the communication device 11 may comprise one or more specialized or general purpose processors, such as a processor 216 for executing the modules 211, 212, 213, 214, and 215. In an embodiment, the alarm device 12 includes a BLUETOOTH module 221, a visual alarm 222, an audio alarm 223, and a processor 224. Additionally, the alarm device 12 may comprise one or more specialized or general purpose processors, such as a processor 217, for executing the modules 221, 222, and 223. In an embodiment, the mobile communication device 3 includes a BLUETOOTH module 231, a control module 232 and a processor 233. Additionally, the mobile communication device 13 may comprise one or more specialized or general purpose processors, such as a processor 233 for executing the modules 231 and 232.

The BLUETOOTH module 231 of the mobile communication device 13 is configured for establishing a wireless connection with the BLUETOOTH module 221 of the alarm device 12. The control module 232 of the mobile communication device 13 is configured for activating the alarm device 12 and the communication device 11. For example, the control module 232 may provide a key of a keypad, a dedicated switch, a command entry on a touch screen on the mobile communication device 13 as an activation command, which activates the alarm device 12 and the communication device 11.

The control module 232 of the mobile communication device 3 is also configured for remotely controlling the communication device 1 and the alarm device 2. For example, a dedicated keypad command on the mobile communication device 13 may provide "Activation" and "Deactivation" choices. When "Deactivation," is selected, the control module 232 transmits a corresponding command to the communication device 11 through a wireless communication network. The communication device 11 identifies the command and further transmits the command to the mobile communication device 13 through the wireless communication network. Here, the wireless communication network may be a General Packet Radio Service (GPRS) network, a Universal Mobile Telecommunication Service (UMTS) network, or any other type of wireless communication network with packet data capability. The communication device 11 deactivates itself after it transmits the command to the mobile communication device 13 successfully. The alarm device 12 deactivates itself after it receives the command successfully. In an embodiment, the control module 232 of the mobile communication device 13 transmits control commands to and also communicates with the communication device 11 through the wireless communication network.

The sensor 216 of the communication device 11 is configured for monitoring the site and detecting noteworthy events after the alarm device 12 is activated. The sensor 216 may be an acoustic wave sensor, a vibration sensor, a combination of the acoustic wave sensor and the vibration sensor, or any other kind of sensor. Furthermore, the sensor 216 of the communication device 11 is also configured for setting a sensitivity parameter of detection such as loudness of sound in decibels (dB) and vibration sensitivity.

If the sensor 216 of the communication device 11 detects the noteworthy event, the sensor 216 outputs an impulse signal to the alarm device 12 for generating visual and audio alerts Additionally, the sensor 216 also outputs an impulse signal to the activation module 212 of the communication device 11. The visual alarm 221 of the alarm device 12 is configured for generating continuous light or other visual alerts after the alarm device 12 receives the impulse signal from the sensor 216. Similarly, the audio alarm 223 of the alarm device 12 is configured for generating a series of audio alerts after the alarm device 12 receives the impulse signal from the sensor 216. The BLUETOOTH module 211 of the communication device 11 transmits the impulse signal from the sensor 216 to the alarm device 12 via the wireless connection of BLUETOOTH. Additionally, the activation module 212 of the communication device 11 is also configured for activating the camera module 213 to capture the visual data according to the activation commands from the sensor 216.

In an embodiment, the communication device 11 is also configured for storing an identification code. The identification code stored may be a mobile phone identification number, an internet protocol address in a computer network system, or any other representation code in a communication system. Here, the memory system 215 of the communication device 11 is configured for storing the identification code of the mobile communication device 13. The communication device 11 may update the memory system 215 so as to add/edit/delete identification codes. In this exemplary embodiment, the communication device 11 stores a preset mobile phone identification number of an UMTS network of the mobile communication device 13. Furthermore, the transmission module 214 of the communication device 11 is configured for transmitting captured visual data to the mobile communication device 13 according to the preset mobile phone identification number. The captured visual data may be embedded in a short message or a file and further transmitted to the mobile communication device 13. Depending on the embodiment, the short message may be a Short message service (SMS), a Multimedia message service (MMS), or an electronic mail (E-mail) message.

Upon receipt of the captured visual data at mobile communication device 13, appropriate action may be taken. If no immediate action is warranted, the communication device 11 and the alarm device 12 may be deactivated or reset via the control module 232 of the mobile communication device 13. An exemplary method of managing site security through the communication device 11 follows.

Figure 3A:
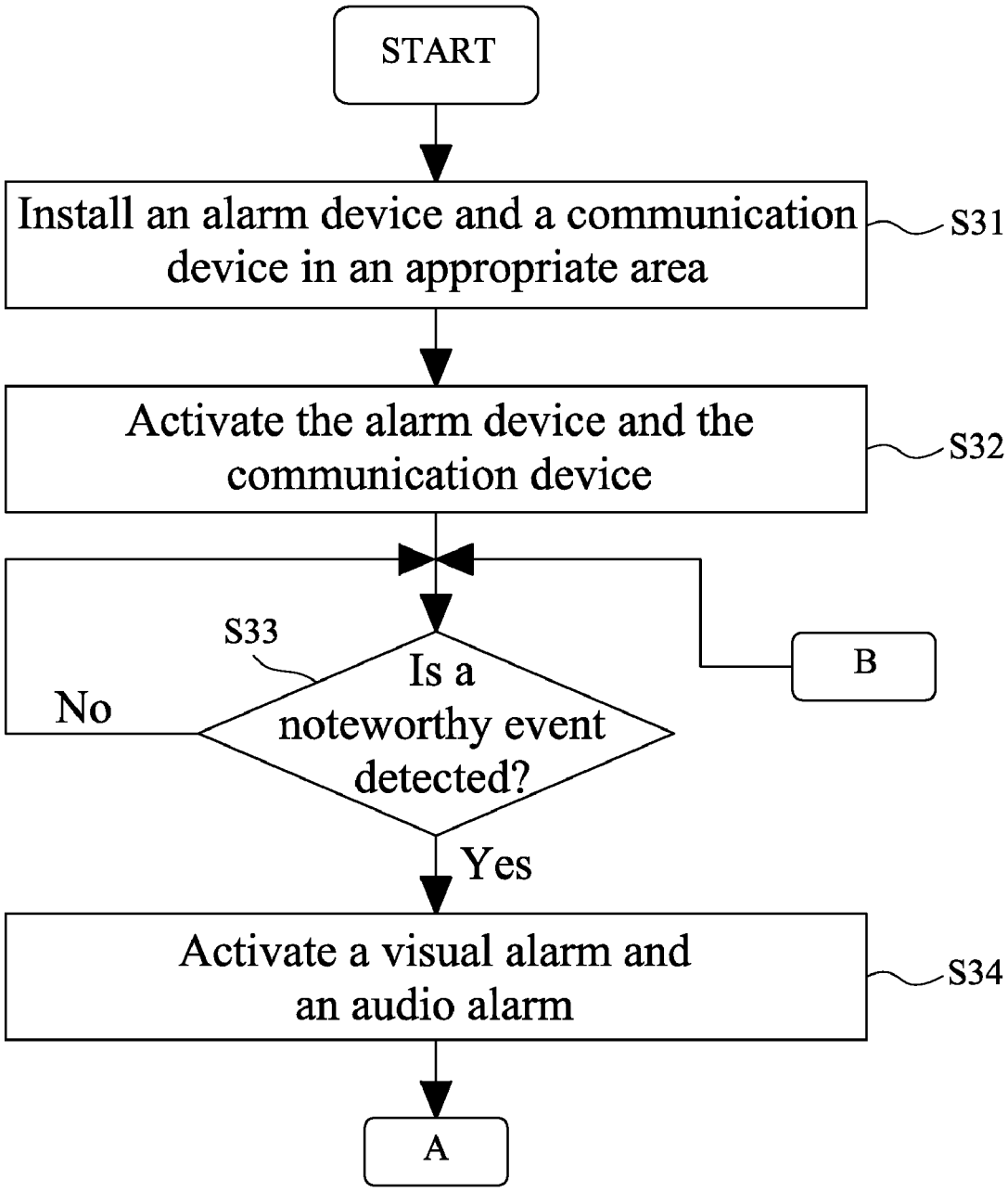
FIG. 3 is a flowchart of an embodiment of a method for managing site security through a communication device.
Figure 3B:
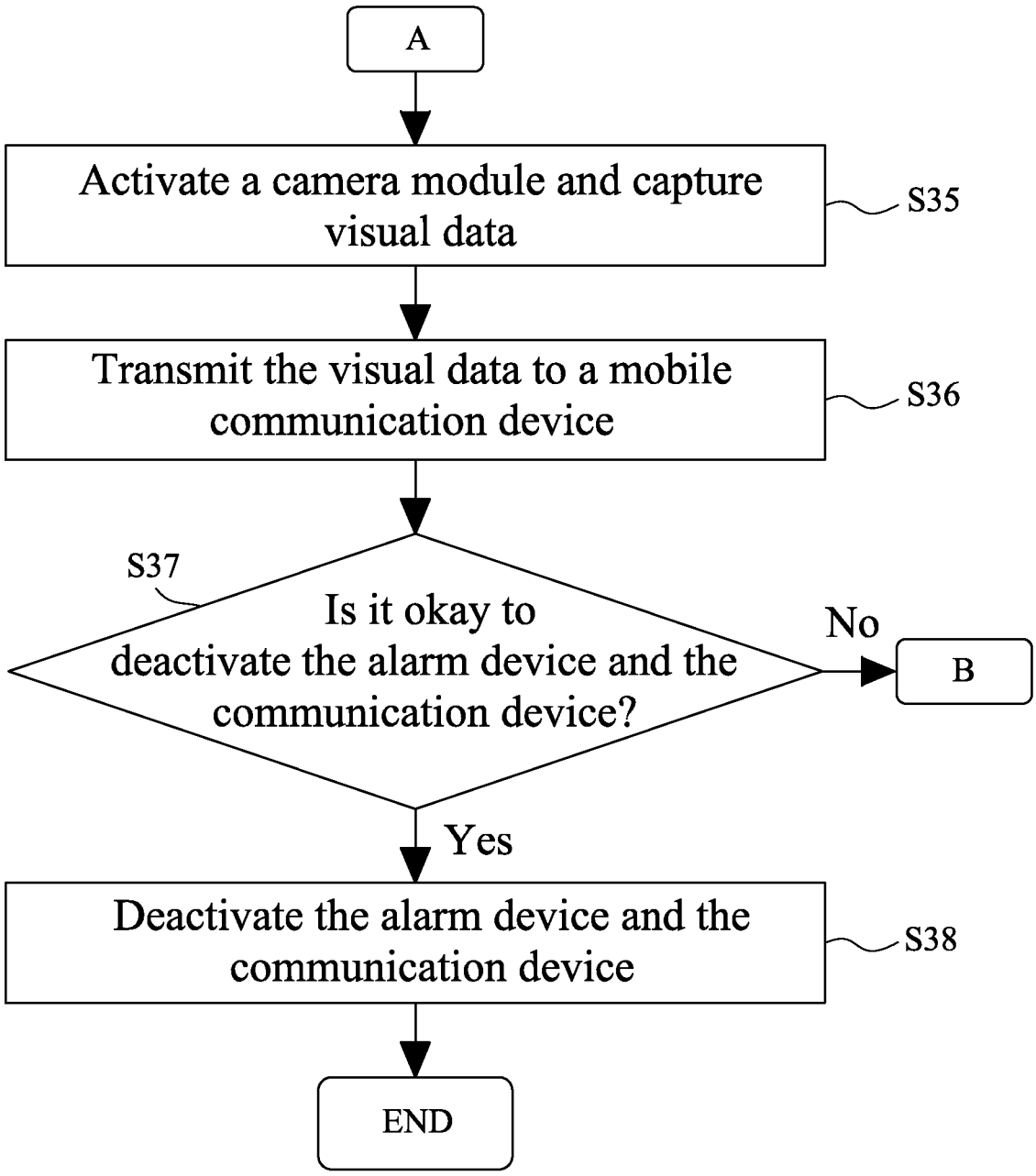

FIG. 3 is a flowchart of an embodiment of a method for managing site security through the communication device 11. Depending on the embodiment, additional blocks may be added, others deleted, and the ordering of the blocks may be changed. Firstly, in block S31, the communication device 11 and the alarm device 12 are installed in an appropriate area of the site to be monitored. Each of the communication device 11, the alarm device 12, and the mobile communication device 13 has the BLUETOOTH modules 211, 221 and 231 to respectively establish the wireless connection of BLUETOOTH.

In block S32, the wireless connection of BLUETOOTH is activated via BLUETOOTH module 231 of the mobile communication device 13 and the BLUETOOTH modules 221 of the communication device 11. The alarm device 12 and the communication device 11 are activated via the control module 232 of the mobile communication device 13. For example, as mentioned previously, the control module 232 provides a preset key of a keypad, a dedicated hardware button, or a command entry on a touch screen of the mobile communication device 13 as the control command. Activation of the preset command directs the control module 232 to transmit a corresponding command to the alarm device 12 to activate both the alarm device 2 and the communication device 11 through the wireless connection of BLUETOOTH.

In block S33, after the communication device 11 is activated, the sensor 216 of the communication device 11 monitors and detects noteworthy events onsite. As mentioned previously, the sensor 216 may be an acoustic wave sensor, a vibration sensor, a combination of the acoustic wave sensor and the vibration sensor, or any other kind of sensor. Additionally, the sensor 216 of the communication device 11 also sets the sensitivity parameter of the detection such as the loudness of sound in decibels (dB) and the vibration sensitivity.

If the sensor 216 of the communication device 11 detects a noteworthy event, in block S34, the sensor 216 outputs an impulse signal to the alarm device 12, and the impulse signal further activates the visual alarm 222 to generate the visual alert and the audio alarm 223 to generate the audio alert. If no noteworthy event is detected, the procedure S33 is repeated to provide continuous detection. Additionally, the sensor 216 also notifies the activation module 212 if the sensor 216 detects the noteworthy event.

In block S35, the activation module 212 of the communication device 11 activates the camera module 213 to capture visual data according to the activation commands from the alarm device 2.

In block S36, the transmission module 214 of the communication device 11 transmits the visual data captured by the camera module 213 to the mobile communication device 13 according to the identification code stored in the memory system 215 of the communication device 11. The identification code stored in the communication device 11 may be a mobile phone identification number, an internet protocol address in a computer network system, or any other representation code in a communication system. Here, communication device 11 stores the identification code of the mobile communication device 13. The communication device 11 may update the memory system 215 so as to add/edit/delete identification codes. The visual data is embedded in a short message or a file and further transmitted to the mobile communication device. Therefore, the visual data is transmitted via the wireless communication network with packet data capabilities.

In block S37, if monitoring is to be continued, S33 is repeated and the sensor 216 continues detection. If not, in block S38, the communication device 11 and the alarm device 12 are deactivated via the control module 232 of the mobile communication device 13 and the process is complete.

It should be emphasized that the described inventive embodiments are merely possible examples of implementations, and set forth for a clear understanding of the principles of the present disclosure. Many variations and modifications may be made to the above-described inventive embodiments without departing substantially from the spirit and principles of the present disclosure. All such modifications and variations are intended to be included herein within the scope of this disclosure and the above-described inventive embodiments, and the present disclosure is protected by the following claims.

What is claimed is:

1. A computing system for managing site security through a communication device, the communication device in communication with an alarm device and a mobile communication device, the communication device comprising:

a memory system configured for pre-storing an identification code of the mobile communication device;

a BLUETOOTH module for communicating with the alarm device and the mobile communication device;

an activation module configured for activating a camera module of the communication device to capture visual data according to an activation command;

a transmission module configured for transmitting the visual data to the mobile communication device according to the identification code;

a sensor configured for detecting if a noteworthy event occurs onsite and outputting an impulse signal to the alarm device for generating visual and audio alerts in response to detecting the noteworthy event; and at least one processor for executing the activation module, the camera module, the transmission module, the sensor, and the memory system.

2. The system as claimed in claim 1, wherein the mobile communication device comprises:

a BLUETOOTH module configured for communicating with the communication device and the alarm device;

a control module configured for activating the alarm device and the communication device through a BLUETOOTH connection; and at least one processor for driving the control module to manage site security through the communication device.

3. The system as claimed in claim 2, wherein the control module of the mobile communication device provides control via the mobile communication device of activation or deactivation of the communication device and the alarm device.

4. The system as claimed in claim 3, wherein the control module of the mobile communication device is further configured for remotely controlling the communication device and the alarm device.

5. The system as claimed in claim 1, wherein the alarm device comprises:

a BLUETOOTH module configured for communicating with the communication device and the mobile communication device;

a visual alarm configured for generating visual alerts;

an audio alarm configured for generating audio alerts; and at least one processor for executing the visual alarm and the audio alarm.

6. The system as claimed in claim 1, wherein the sensor of the communication device is further configured for setting a sensitivity parameter of detection.

7. The system as claimed in claim 1, wherein the visual data is embedded in a short message and further transmitted to the mobile communication device via a Universal Mobile Telecommunication Service (UMTS) network.

8. The system as claimed in claim 1, wherein the visual data is embedded in a short message and further transmitted to the mobile communication device via a Global System for Mobile communication system (GSM) network.

9. The system as claimed in claim 1, wherein the visual data is embedded in a short message and further transmitted to the mobile communication device via a wireless communication network with packet data capability.

10. A computer-implemented method for managing site security through a communication device, the method comprising:

communicating with an alarm device via a first BLUETOOTH module;

communicating with a mobile communication device via a second BLUETOOTH module;

activating the alarm device and the communication device from the mobile communication device through a BLUETOOTH connection;

detecting if a noteworthy event occurs onsite, and outputting an impulse signal to the alarm device in response to if a noteworthy event occurs;

generating an audio alert via the alarm device;

generating a visual alert via the alarm device;

activating a camera module of the communication device to capture visual data according to an activation command;

storing an identification code of the mobile communication device; and transmitting the visual data to the mobile communication device according to the identification code.

11. The method as claimed in claim 10, wherein the method further comprises:

determining whether to continue detection, and;

resetting the communication device and the alarm device to continue detection in response to continuing the detection via the mobile communication device; and deactivating the communication device and the alarm device in response to not continuing the detection via the mobile communication device.

12. The method as claimed in claim 10, wherein the visual data is embedded in a short message and further transmitted to the mobile communication device via a Universal Mobile Telecommunication Service (UMTS) network.

13. The method as claimed in claim 10, wherein the mobile communication device further provides control via the mobile communication device for activating or deactivating the communication device and the alarm device.

14. A non-transitory computer-readable medium having stored thereon instructions that, when executed by a computer, cause the computer to perform a method for managing site security through a communication device, the method comprising:

communicating with an alarm device via a first BLUETOOTH module;

communicating with a mobile communication device via a second BLUETOOTH module;

activating the alarm device and the communication device from the mobile communication device through a BLUETOOTH connection;

detecting if a noteworthy event occurs onsite, and outputting an impulse signal to the alarm device in response to if a noteworthy event occurs;

generating an audio alert via the alarm device;

generating a visual alert via the alarm device;

activating a camera module of the communication device to capture visual data according to the activation command;

storing an identification code of the mobile communication device; and transmitting the visual data to the mobile communication device according to the identification code.

15. The non-transitory computer-readable medium as claimed in claim 14, wherein the method further comprises:

determining whether to continue detection, and;

resetting the communication device and the alarm device to continue detection in response to continuing the detection via the mobile communication device; and deactivating the communication device and the alarm device in response to not continuing the detection via the mobile communication device.

16. The non-transitory computer-readable medium as claimed in claim 14, wherein the visual data is embedded in a short message and further transmitted to the mobile communication device via a Universal Mobile Telecommunication Service (UMTS) network.

17. The non-transitory computer-readable medium as claimed in claim 14, wherein the mobile communication device further provides control via the mobile communication device for activating or deactivating the communication device and the alarm device.

* * * * *